US007059739B2

(12) United States Patent
Wong

(10) Patent No.: US 7,059,739 B2
(45) Date of Patent: Jun. 13, 2006

(54) SKATES WITH FLASHING LIGHTS

(75) Inventor: Wai Kai Wong, Kowloon (HK)

(73) Assignee: Cheerine Development (Hong Kong) Ltd., Hong Kong (CN)

( * ) Notice: Subject to any disclaimer, the term of this patent is extended or adjusted under 35 U.S.C. 154(b) by 352 days.

(21) Appl. No.: 10/273,234

(22) Filed: Oct. 17, 2002

(65) Prior Publication Data

US 2004/0075997 A1 Apr. 22, 2004

(51) Int. Cl.
*F21V 21/08* (2006.01)

(52) U.S. Cl. ..... 362/103; 362/231; 362/800; 280/11.203

(58) Field of Classification Search ..... 362/459, 362/103, 555, 800, 545, 543, 191, 253, 273, 362/289; 280/11.12, 11.18, 11.221, 11.203
See application file for complete search history.

(56) References Cited

U.S. PATENT DOCUMENTS

| | | | | | |
|---|---|---|---|---|---|
| 3,992,618 | A | * | 11/1976 | Matthews et al. | 362/396 |
| 4,308,572 | A | | 12/1981 | Davidson et al. | |
| 4,363,502 | A | | 12/1982 | Bakerman | |
| 4,367,515 | A | * | 1/1983 | Beard | 362/103 |
| 4,463,412 | A | | 7/1984 | Broach | |
| 4,489,957 | A | | 12/1984 | Holmgren | |
| 4,661,895 | A | * | 4/1987 | Hull | 362/427 |
| 4,848,009 | A | | 7/1989 | Rodgers | |
| 4,991,066 | A | * | 2/1991 | McCowan | 362/464 |
| 4,997,196 | A | * | 3/1991 | Wood | 280/87.042 |
| 5,113,325 | A | | 5/1992 | Eisenbraun | |
| 5,119,277 | A | * | 6/1992 | Copley et al. | 362/543 |
| 5,132,883 | A | * | 7/1992 | La Lumandier | 362/466 |
| 5,327,329 | A | | 7/1994 | Stiles | |
| 5,422,628 | A | | 6/1995 | Rodgers | |
| 5,484,164 | A | * | 1/1996 | McInerney et al. | 280/11.203 |
| 5,516,149 | A | | 5/1996 | Moore | |
| 5,552,971 | A | | 9/1996 | Madden | |
| 5,588,734 | A | | 12/1996 | Talamo et al. | |
| 5,653,523 | A | | 8/1997 | Roberts | |
| 5,663,614 | A | | 9/1997 | Weng et al. | |
| 5,683,164 | A | | 11/1997 | Chien | |
| 5,716,119 | A | | 2/1998 | Patel | |
| 5,730,520 | A | | 3/1998 | Hsu et al. | |
| 5,754,064 | A | | 5/1998 | Chien | |

(Continued)

FOREIGN PATENT DOCUMENTS

| | | |
|---|---|---|
| EP | 0 427 920 A1 | 5/1991 |
| EP | 0 773 529 A1 | 5/1997 |
| GB | 2 361 624 A | 10/2001 |

OTHER PUBLICATIONS

Combined Search and Examination Report dated Jul. 14, 2003, for corresponding United Kingdom application GB 0306157.9.

*Primary Examiner*—John Anthony Ward
*Assistant Examiner*—Hargobind S Sawhney
(74) *Attorney, Agent, or Firm*—Brinks Hofer Gilson & Lione

(57) ABSTRACT

An illuminating device with flashing lights may is adjustably affixable to ice skates or in-line skates. The illuminating device may include a number of lamps or light emitting diodes (LEDs) and is controlled by a motion switch or other switch. The lamps or LEDs are visible from the inside of a transparent box which is installed in the hollow between the shoe portion of the skate and the blade or wheels of the skate. The illuminating device is necessarily compact in nature, consisting primarily of flashing lights and a power-and-control circuit that controls and enables the flashing of the lights. The lights may be flashed sequentially, in-phase, randomly, or in other desirable patterns.

20 Claims, 7 Drawing Sheets

U.S. PATENT DOCUMENTS 5,812,063 A 9/1998 Weng et al.
5,813,148 A 9/1998 Guerra
5,821,858 A 10/1998 Stone
5,823,657 A * 10/1998 Price et al. ..... 362/191
5,839,814 A 11/1998 Roberts
5,844,377 A 12/1998 Anderson et al.
5,855,382 A * 1/1999 Reilly et al. ..... 280/11.19
5,894,201 A 4/1999 Wong
5,903,103 A 5/1999 Garner
5,909,088 A 6/1999 Wut
5,921,653 A 7/1999 Chien
5,945,911 A 8/1999 Healy et al.
5,957,541 A 9/1999 Seigler
5,969,479 A 10/1999 Wong
6,094,141 A 7/2000 Tsai
6,104,140 A 8/2000 Wut et al.
6,164,794 A 12/2000 Rodgers
6,170,968 B1 1/2001 Caswell
6,238,055 B1 * 5/2001 Wallace ..... 362/103
RE37,220 E 6/2001 Rapisarda et al.
6,241,371 B1 6/2001 Dai
6,332,692 B1 * 12/2001 McCurdy ..... 362/103
6,398,395 B1 6/2002 Hyun
6,416,327 B1 7/2002 Wittenbecher
6,450,659 B1 * 9/2002 Salatino ..... 362/103
6,525,487 B1 2/2003 Wei
6,619,812 B1 9/2003 Rapisarda
2003/0137852 A1 7/2003 Rapisarda
2003/0185019 A1 10/2003 Rogers et al.

* cited by examiner

SKATES WITH FLASHING LIGHTS

FIELD OF THE INVENTION

This invention relates to ice skates and in-line skates, and more particularly to a system for illuminating devices incorporated into ice skates or in-line skates.

BACKGROUND OF THE INVENTION

Lighting systems have been incorporated into footwear, generating distinctive flashing of lights for a person wearing the footwear. These systems generally have an inertia switch, so that when a runner's heel strikes the pavement, the switch moves in one direction or another, triggering a response by at least one circuit that typically includes a power source and a means for powering and controlling the lights. The resulting light flashes are useful in identifying the runner, or at least the presence of a runner, because of the easy-to-see nature of the flashing lights. Thus, the systems may contribute to the fun of exercising while adding a safety feature as well.

These lighting systems, however, suffer from a number of deficiencies. Besides conventional footwear or running shoes, it may be fun to incorporate flashing lights into recreational footwear, such as in-line skates or ice skates. Since the purpose of in-line skates and ice skates is recreation, the addition of lights seems a logical extension both for flashing light systems and for the fun of wearing and using skates. There are, however, problems associated with the use of flashing light systems in these skates.

One prior art system is depicted in U.S. Pat. No. 5,327,329. This patent depicts a system of lighting attachments for roller skates or in-line skates in which small boxes which hold the lights are adhered to the sides of the skates by means of double-sided adhesive tape or by hook-and-loop material, such as Velcro® fasteners. While the system and the light would likely be easy to install and remove, double-sided adhesive tape or hook-and-loop fasteners may not provide the most stable attachment of the system to the skates. Thus, the lights may detach from the skates when they are in motion, and in particular when they encounter an obstacle, or after a period of time when the adhesive ages and loosens. There is also no way shown to adjust the lighting system according to the size of the skates used.

The need for a mechanism to be able to adjust at least one dimension of the lighting system is also apparent in U.S. Pat. No. 5,552,971. In this patent, a length of a lighting system for in-line skate lights is "adjustable," in that there is a spring that may lengthen or shorten automatically when the lighting system is attached to skates of different sizes. Such a system depends on the spring at the rear of the skate to adjust to skates of different sizes, and yet also depends on that spring for adherence to the skate. These are two purposes that may be mutually exclusive, in that a spring that is easy to adjust may not be strong enough to reliably and consistently hold the illuminating system onto the skate. In addition, it appears from at least one view of this patent, that the lighting system may impact the ground if the wearer goes into a sharp bank, bringing the lighting system into contact with the cement or other surface the user is skating upon, and damaging at least part of the lighting system.

The prior art is thus seen to be deficient in that there is not presently a good mechanism for adjusting the length of a skate lighting system. Present systems may also bring parts of the lighting system into contact with the ground when the user turns or banks sharply, thus, the present invention is directed at correcting these and other deficiencies in the prior art.

SUMMARY

One embodiment of the invention is an illuminating system for a skate. The illuminating system comprises a switch and an integrated circuit operably connected to the switch for storing and generating at least one pattern of signals. The system also comprises a plurality of lamps, operably connected to the integrated circuit, the plurality of lamps selected from the group consisting of incandescent lamps, LEDs, bi-color LEDs, and tri-color LEDs, wherein the integrated circuit causes the plurality of lamps to flash in the at least one pattern. The illuminating system also comprises a housing affixable to the skate with an adjusting screw, the housing containing the plurality of lamps.

Another embodiment of the invention is an illuminating system for an ice skate or an in-line skate. The illuminating system comprises at least one switch and an integrated circuit connected to the switch. There is a plurality of lamps operably connected to the integrated circuit, the plurality of lamps selected from the group consisting of incandescent lamps, LEDs, bi-color LEDs, and tri-color LEDs. There is also a housing affixable to the skate with an adjusting screw, the housing containing the plurality of lamps.

Another embodiment of the invention is a method for attaching an illuminating system to an ice skate or an in-line skate. The method comprises placing the illuminating system with a housing on the ice skate or in-line skate, and adjusting a fit of the housing on the skate with an adjusting screw. Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF THE FIGURES.

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

DETAILED DESCRIPTION OF THE PRESENTLY PREFERRED EMBODIMENTS

Figure 1:
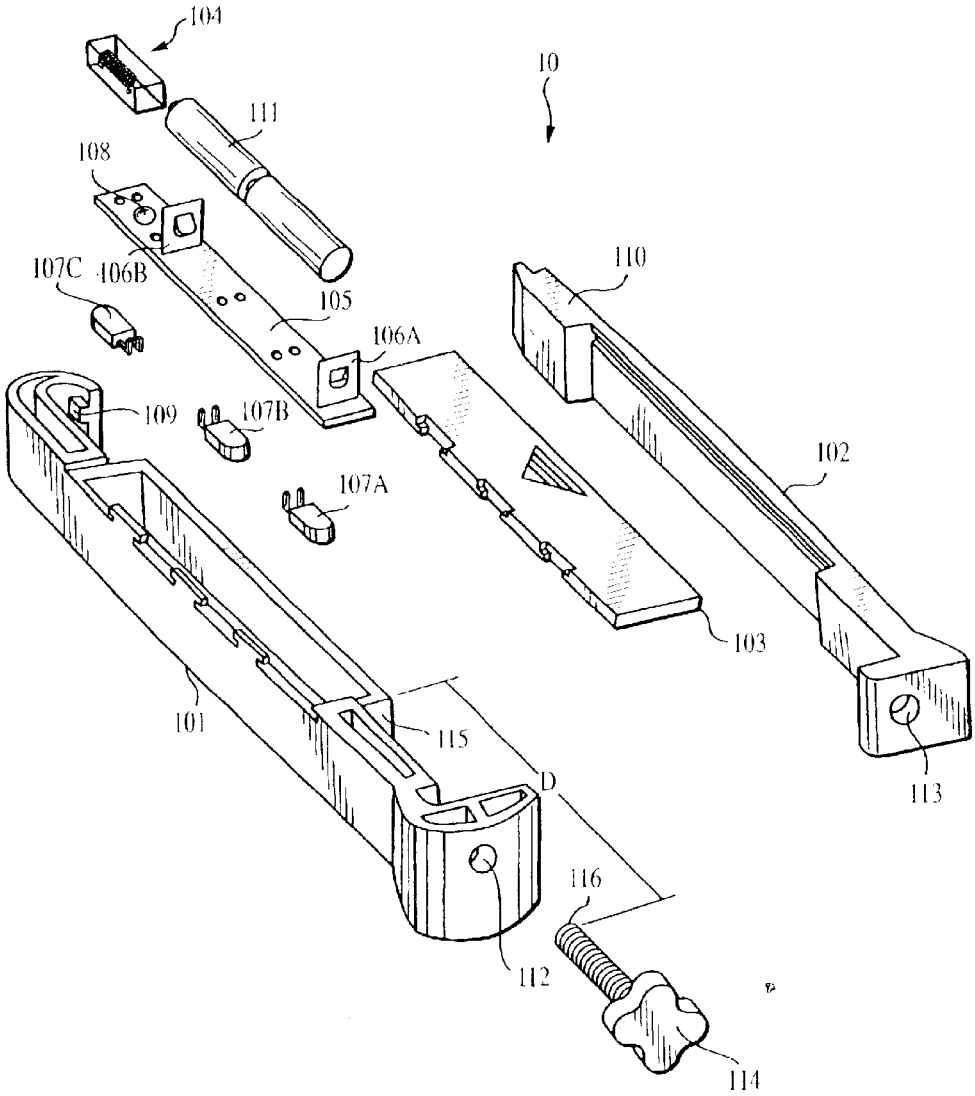
FIG. 1 is an exploded view of an embodiment of an adjustable lighting system.

Lighting or illuminating systems for ice skates are necessarily compact and rugged, so that the skates to be illuminated can easily hold the illuminating system, and so the illuminating system will endure for a long period of use. An adjustable illuminating system adapted for ice skates and in-line skates is depicted in FIGS. 1. The adjustable illuminating system 10 comprises a plastic housing made from a left female portion or half 101 with front tip 109 and a right male portion or half 102 with front tip 110. The portions are designed to fit together with a cover 103 over inner housing 115 for containing the inner components of the illuminating system. The inner components of the illuminating system may include an inertia switch 104, one or more batteries 111, a printed circuit board 105, battery contacts 106*a* and 106*b*, integrated circuit 108, and lamps or LEDs 107*a*, 107*b* and 107*c*. The housing portions are equipped with threaded apertures 112, 113, for threading of an adjusting screw 114 after the portions are assembled onto an ice skate or in-line skate. The adjusting screw 114 snugs the end 116 of the adjusting screw 114 against a rear rib or other feature of the ice skate or in-line skate. It is the adjusting screw 114 that allows a user or manufacturer to adjust the size of the illuminating system, and thus to fit the illuminating system onto a skate. The illuminating system is thus affixable to a skate by means of the adjusting screw.

The housing is desirably made of a transparent or translucent (partially transparent) plastic. Plastics that may be suitable include styrene-acrylonitrile (SAN), polycarbonate, polystyrene, polyethylene, polypropylene, polyethyleneterephthlate, acrylic and acrylic blends, and many others. The plastic may be clear or a light-white color ("natural"), or may be pigmented with a small amount of translucent color that allows light to pass through, enabling light from one or more LEDs or other lamps to shine through the housing.

Figure 2:
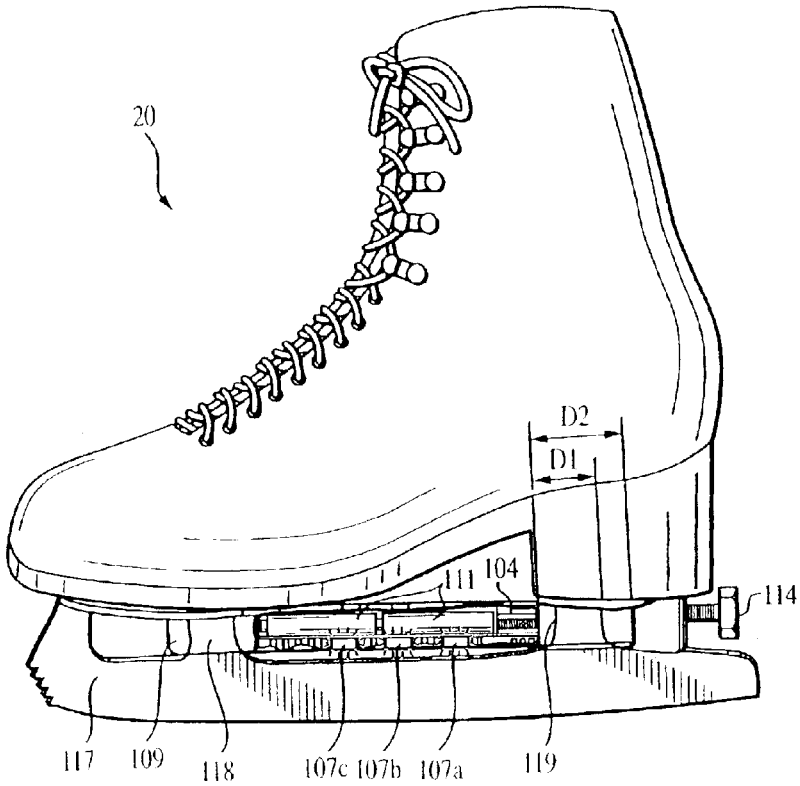
FIG. 2 is a partial cross-sectional view of an ice skate with the embodiment of FIG. 1.

The illuminating system is depicted affixed to or mounted on an ice-skate 20 in FIG. 2. The blade 117 of the ice skate has at least two ribs 118, 119 used for mounting the illuminating system 10. The adjustment screw 114 is seen snugging the illuminating system into the skate. In one way of practicing the invention, one side or portion of the illuminating systems is placed on one side of a skate, and then the other portion is placed on the other side of the skate. The two portions of the illuminating system are joined, and then affixed or secured to the skate with the adjustment screw. Also visible in this partial cross-sectional view are LEDs 107*a*, 107*b*, 107*c*, batteries 111, and motion switch 104. Note that in this view, the illuminating system can accommodate differences in length of the ice skate from about dimension D1 to about dimension D2. Thus, the illuminating system may be used on ice skates of different sizes.

Figure 3:
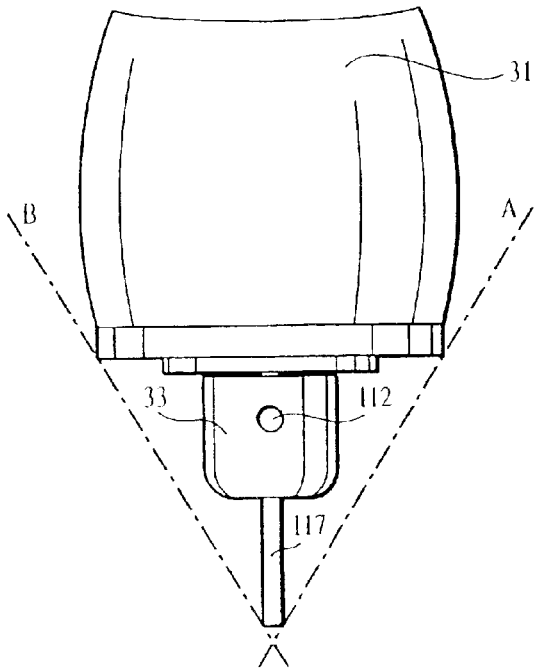
FIG. 3 is a rear elevational view of an embodiment and an ice skate.

FIG. 3 depicts a rear elevational view of the skate heel 31, an end view of the housing 33 with threaded aperture 112 for an adjusting screw, and blade 117. Note that line A, from heel 31 to blade 117 does not intersect or touch the illuminating system housing 33, nor does line B on the opposite side of the skate. The angle between line A and line B is about 60 to about 90 degrees. The lines are meant to depict planes on opposite sides of the skate, the planes intersecting the skate on an inmost or outmost point of the heel on one end of the plane. The plane extends forward from the heel to a convenient point on the front of the skate, the plane extending at least as far as the housing for the illuminating system. The plane also extends downward to the blade of an ice skate or the wheels of an in-line skate. The plane thus defines a space on the footwear where an illuminating system may safely reside without fear of contacting the ground or other surface during normal use. Thus, a skater using ice skates with the illuminating system can bank and turn at a steep angle without damaging the illuminating system.

Figure 4A:
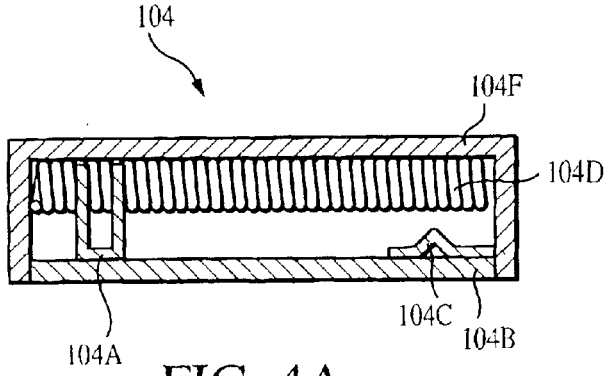
FIGS. 4*a* and 4*b* are cross-sectional views of an inertia switch.
Figure 4B:
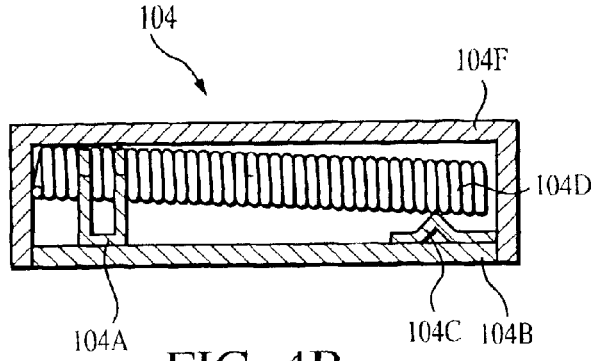

The illuminating system is controlled by a motion switch 104, as shown in FIGS. 4*a* and 4*b*. FIG. 4*a* shows the motion switch 104 in its non-contacting position. The motion switch may be contained within an insulating container 104*b* with lid 104*f*, which may be removable or not removable as desired. The switch includes a spring 104*d* and a spring holder 104*a*. The spring itself is metallic and provides the contact between the fixed end of the spring (at 104*a*) and another contact 104*c* at the other, movable end of the spring. The fixed end of the spring or the fixed contact 104*a* is in electrical contact with the integrated circuit 108 that controls the illuminating system. When the skater moves, and provides motion to switch 104, the spring 104*d* may momentarily touch contact 104*c*, which is connected to one or more batteries 111. The spring thus contacts battery 111 (shown in FIG. 1) at one end and integrated circuit 108 (also shown in FIG. 1) at the other end, and the illuminating system is activated.

Figure 4C:
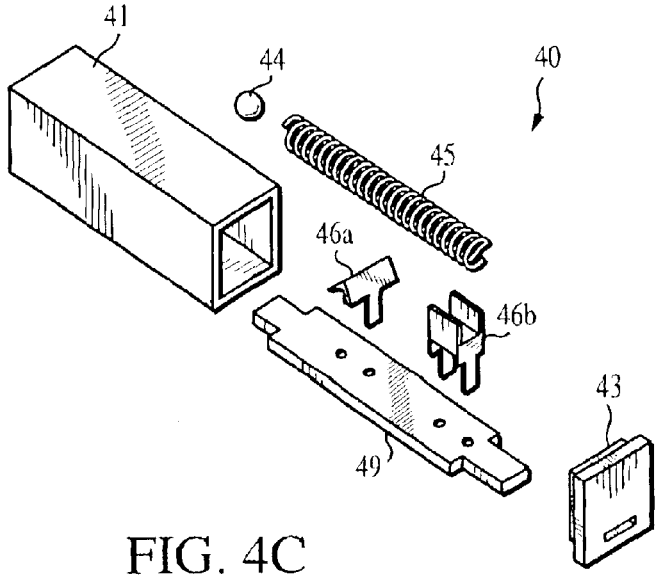
FIG. 4*c* is an exploded view of an alternate embodiment of an inertia switch.

In a preferred embodiment, the motion or inertia switch uses a metal spring and a metal ball, as depicted in FIG. 4*c*. Motion switch 40 includes a non-conducting or plastic housing 41, non-conductive end housing 43, and non-conducting bottom portion 49 for mounting first metallic contact 46*a* and second metallic contact 46*b*. Metallic spring 45 is mounted in second contact 46*b*, preferably by soldering or brazing. Weight 44 is mounted to the other end of the metallic spring to enhance the deflection of the spring in the direction of first metallic contact 46*a* when the skater and the skate are in motion. Weight 44 may be metallic, and may be soldered to the spring. Weight 44 may alternatively be ceramic, plastic, or other material that will enhance the deflection of the spring. Bottom portion 49 may also connect first metallic contact 46*a* and second metallic contact 46*b* to the circuit outside the housing.

Figure 5:
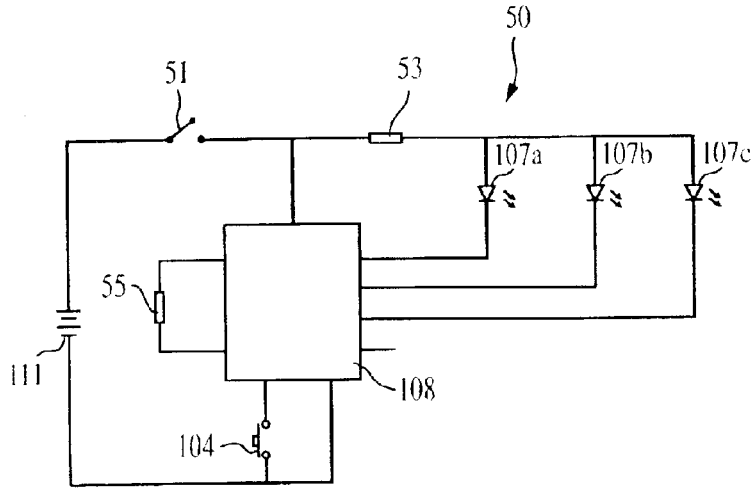
FIG. 5 is a schematic view of a control system for the embodiment of FIG. 1.

A control scheme for the illuminating system is depicted in FIG. 5. In this control circuit 50, integrated circuit 108 is connected to one or more batteries 111 through inertia or motion switch 104. The battery may be directly connected to the Vdd terminal of integrated circuit 108 or may be connected through an additional switch 51, such as a toggle switch or on/off switch. In this embodiment, the circuit includes a load resistor 53 as a current limit, and three LEDs 107*a*, 107*b*, 107*c*, also connected to outputs of integrated circuit 108. An additional resistor 55, such as an oscillator control resistor, may be added to control the flashing rate of the illuminating circuit through an oscillator portion of the integrated circuit. In this embodiment, the integrated circuit may be model M1389 made by MOSDesign Semiconductor Corp., of Taipei, Taiwan. The circuit may be programmed with a predetermined flashing pattern for the LEDs. For instance, if there are three LEDs, they may be programmed to flash in a desired sequence forward, backward, alternating back and forth, and so on.

Figure 6:
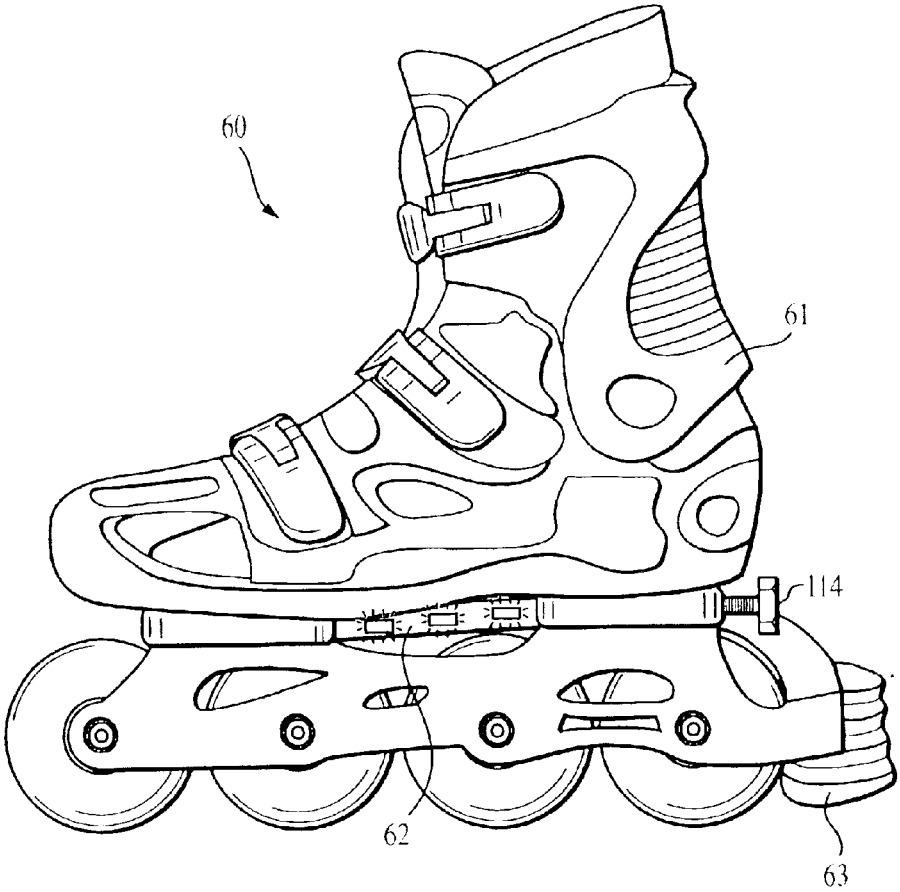
FIG. 6 is an elevational view of an in-line skate with an adjustable lighting system.

As mentioned above, the illuminating circuit embodiments of the present invention are not limited to use on ice skates. Another application for this invention is in-line skates. An embodiment of an illuminating system on an in-line skate appears in FIG. 6. An in-line skate 61 is equipped with an illuminating system 62 according to the present invention, the illuminating system mounted on the wheel bracket 63 of the skate. An adjustment screw 114 is also provided secure the illuminating system onto the skate.

Another aspect of the invention uses LEDs that have two colors, such as red and green. Many other color combinations are commercially available and may be used. The LED may have a common cathode and three leads, including common cathode, red anode and green anode. Other two-color LEDs may have only two leads, in which the anode for one color is the cathode for the other color, and vice versa. Circuits using two-color LEDs are depicted in FIGS. 7–9.

Figure 7:
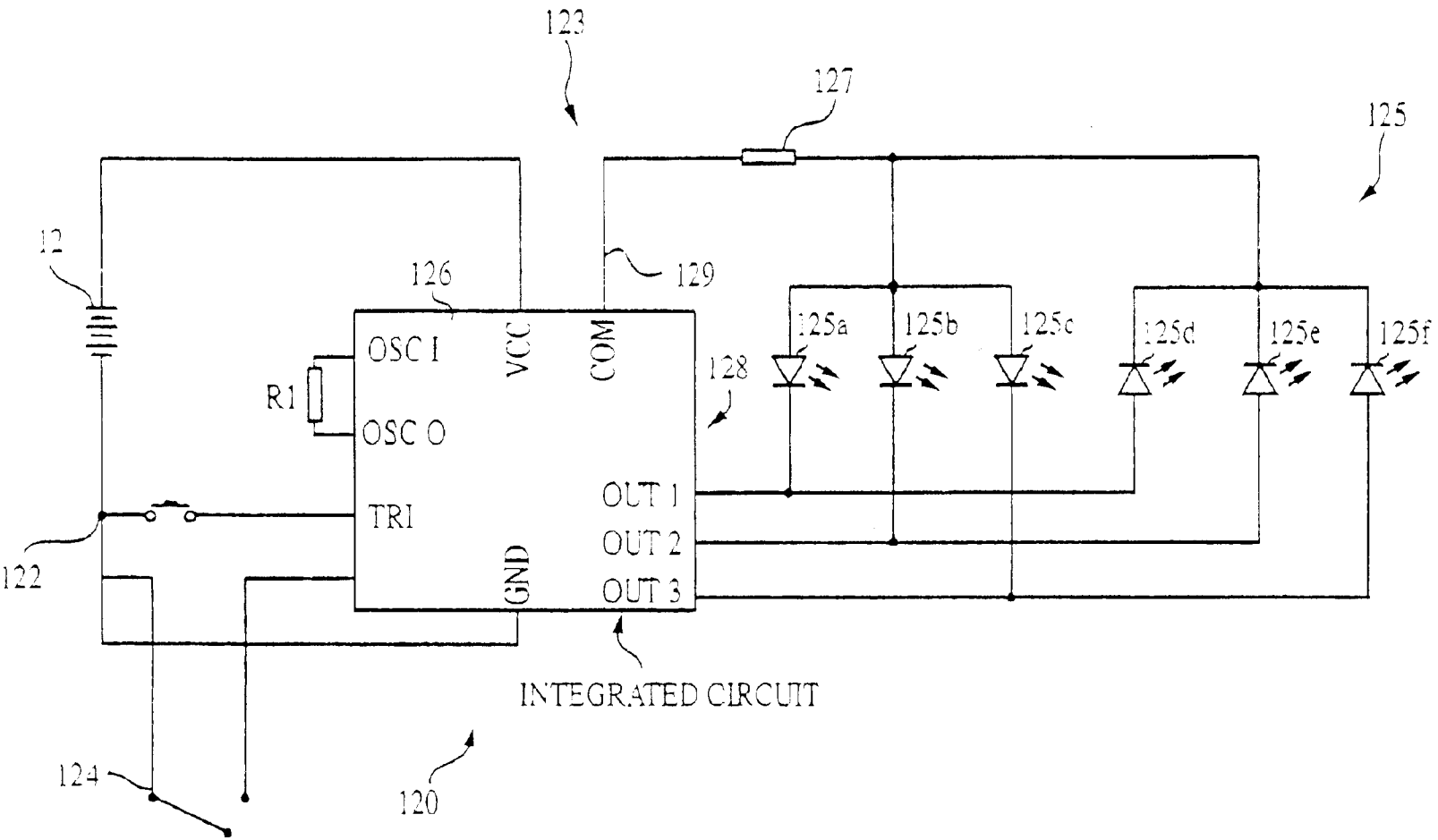
FIG. 7 is a schematic view of an embodiment with two-color LEDs

FIG. 7 depicts an embodiment of an illuminating system using two-color LEDs. The illuminating system 120 includes a power source 12, such as a battery. The system also includes a control portion 123 and an illuminating portion 125, comprising a plurality of LEDs 125*a*, 125*b*, 125*c*, 125*d*, 125*e*, 125*f*. The system includes at least one switch 122, such as a spring or inertia switch, and preferably has an additional switch 124. Preferably the illuminating system includes an oscillator clock 126 for timing the control portion. The control portion has a plurality of outputs 128 and a common terminal 129. The illuminating circuit may have a resistor 127 to control current to the LEDs. The control portion may be an integrated circuit in which a voltage such as Vcc may be switched between the common terminal 129 and the output terminals 128. At the same time, circuit ground may also be switched to any of the output terminals 128. Note that in this circuit, LED 125*a* and LED 125*d* are both connected with the common terminal (and with the circuit resistor), as well as output 1. Thus, LED 125*a* and LED 125*d* may be equivalent to a two-color, two-lead LED 86 in FIG. 9, with LED 125*b* and LED 125*e* comprising a second two-color, two-lead LED, and LED 125*c* and LED 125*f* comprising a third, two-color, two-lead LED. Other circuits may use three-lead two-color LEDs as depicted in FIG. 8.

Figure 8:
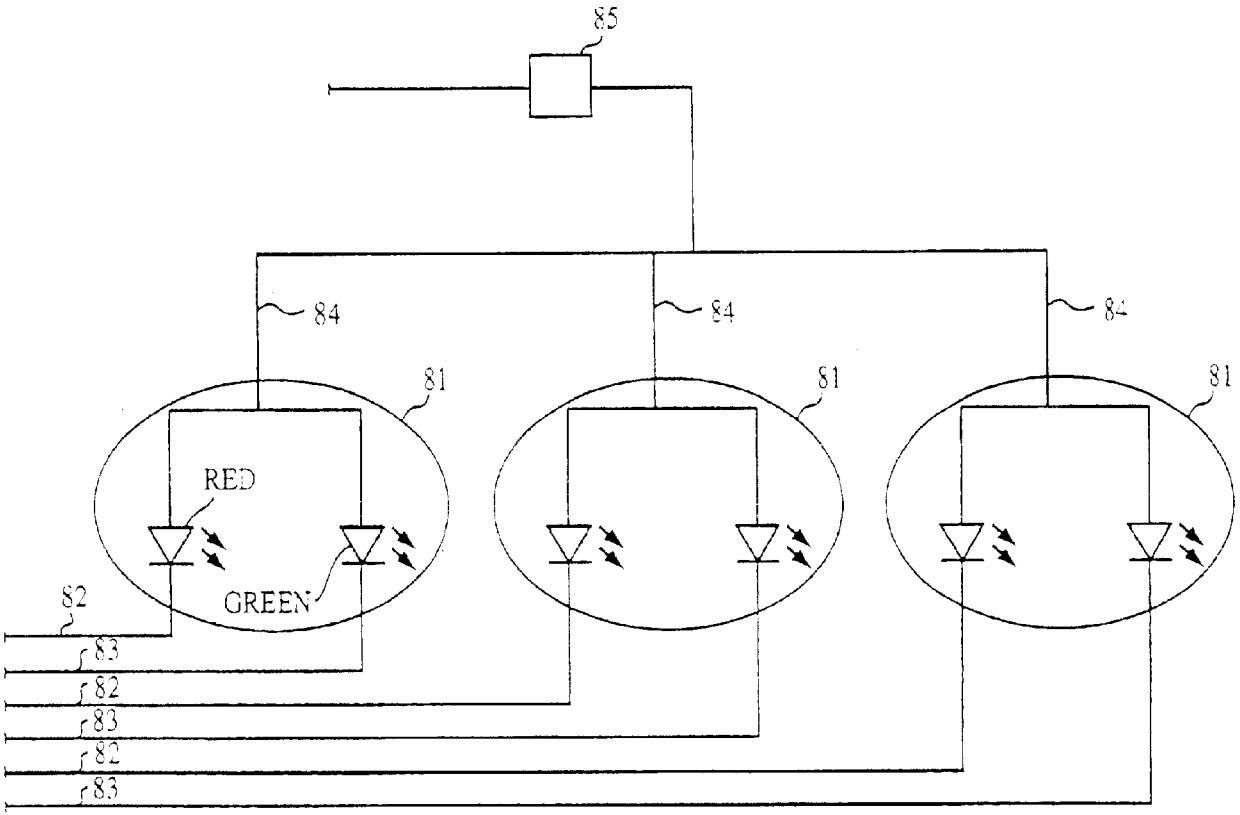
FIGS. 8–9 are schematic view of two kinds of two-color LEDs.

FIG. 8 depicts a portion of an illuminating circuit with two-color LEDs 81. These LEDs have three leads, such as those produced by Kingbright Electronic Co., Ltd. of Hong Kong and distributed worldwide. In this embodiment, LED 81 has a red cathode 82, a green cathode 83, and a common anode 84. Also present in the circuit is current limiting resistor 85. The anodes 82, 83 are connected to the outputs of an integrated circuit, as shown above, or to the outputs of a signal generator, such as an integrated circuit. In this example, the integrated circuit and the illuminating portion are capable of reversing current direction. The rest of the circuit functions as previously described, with many more sequences of flashing patterns possible, since now the colors may be changed by using, as preferred, the red and green lights.

Figure 9:
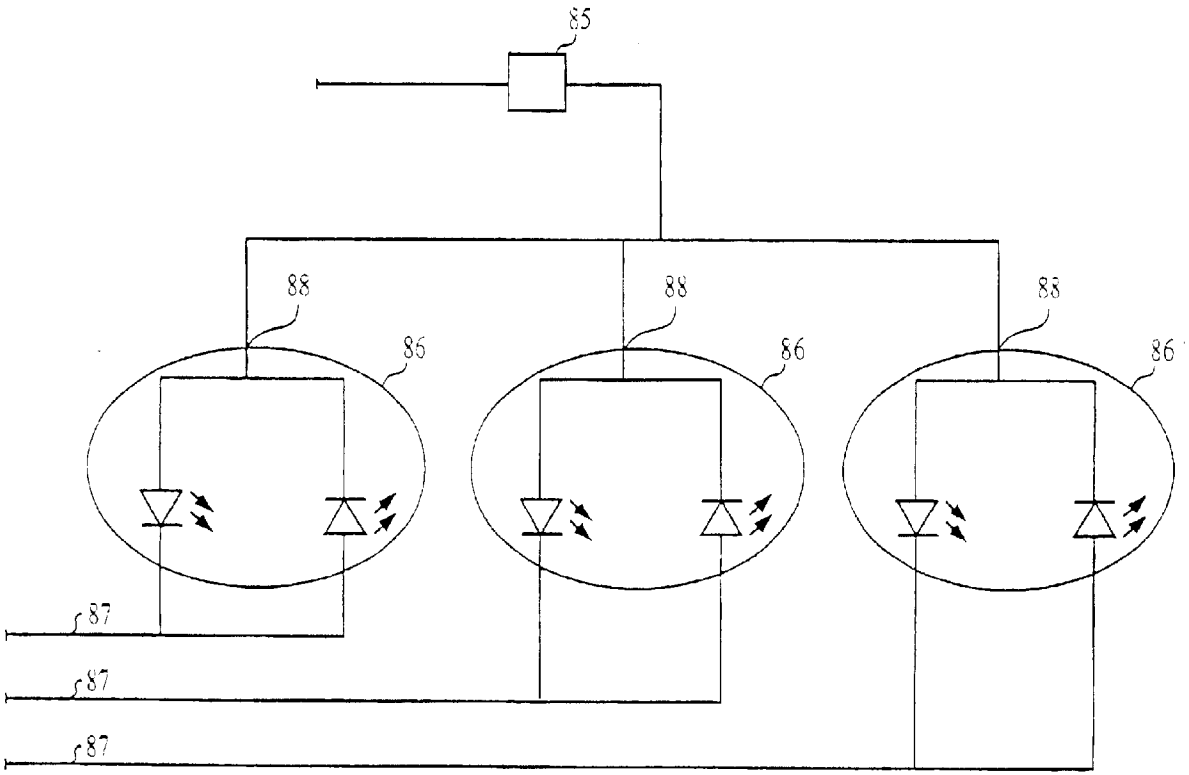

Another embodiment is shown in FIG. 9 with two-lead LEDs 86. As mentioned above, these LEDs, such as those produced by Chicago Miniature Lamp, Inc., Hackensack, N.J., have only two leads, in which the cathode for one LED is the anode for the other lamp. In one example, the cathode for the red LED is electrically common with the anode for the green LED, and the cathode for the green LED is common with the anode for the red LED. Each LED 86 has two points for connection to an illuminating circuit. Point 87 is the cathode for the green LED and is the anode for the red LED. Point 88 is the cathode for the red LED and is the anode for the green LED. The LEDs may be connected to a signal generator and to a power supply through limiting resistor 85. In this embodiment, the current must reverse direction in order to change from one color of LED to another. This is easily provided by reversing outputs of the control circuit, such as an integrated circuit or a decade counter.

At present, tri-color LEDs are sold at a premium to single-element LEDs and bi-color LEDs. A tri-color LED may be used in the circuits discussed above for single color and bi-color LEDs, using the appropriate connections for power from anode to cathode, for premium versions of the flashing light systems of the present invention. Other combinations of lights, such as a single filament or dual-filament incandescent lamp, may also be used.

It will be understood that embodiments covered by claims below will include those with one of the above switches, as well as two or more of these switches, so that economy of operation may be achieved, while at the same time providing for a variety of pleasing applications. Thus, one embodiment may have a toggle switch both for economy of operation and for continual flashing, and may also have a touch-button switch for changing the pattern of the lights flashing from one pattern to another. Either of these embodiments may also incorporate an inertia switch, which may act to re-charge a timing circuit and may also change the pattern of flashing.

Any of the several improvements may be used in combination with other features, whether or not explicitly described as such. Other embodiments are possible within the scope of this invention and will be apparent to those of ordinary skill in the art. Therefore, the invention is not limited to the specific details, representative embodiments, and illustrated examples in this description. Accordingly, the invention is not to be restricted except as necessitated by the accompanying claims and their equivalents.

What is claimed is:

1. An illuminating system for a skate, the system comprising:

a switch;

an integrated circuit operably connected to the switch for storing and generating at least one pattern of signals;

a plurality of lamps operably connected to the integrated circuit, the plurality of lamps selected from the group consisting of incandescent lamps, LEDs, bi-color LEDs, and tri-color LEDs, wherein the integrated circuit causes the plurality of lamps to flash in the at least one pattern; and a housing mounted to the skate with an adjusting screw, the housing containing the plurality of lamps, wherein the adjusting screw allows the housing to be mounted to skates of different sizes.

2. The system of claim 1, wherein the housing also contains the switch and the integrated circuit, and further comprising at least one battery within the housing, the at least one battery connected to the switch.

3. The system of claim 1, wherein the housing is within a space defined by the skate and a plane intersecting the skate.

4. The system of claim 1, wherein the housing comprises two portions.

5. The system of claim 1, wherein the at least one pattern is selected from the group consisting of a random pattern, a sequence, a reverse sequence, an in-phase pattern, and an out-of-phase pattern.

6. The system of claim 1, wherein a user selects the pattern with the switch.

7. The system of claim 1, wherein the switch is selected from the group consisting of an inertia switch, a touch switch and an on/off switch.

8. The system of claim 1, further comprising a power supply connected to the switch.

9. The system of claim 1, wherein the skate is an ice skate.

10. The system of claim 1, wherein the skate is an in-line skate.

11. An illuminating system for an ice skate or an in-line skate, the system comprising:

at least one switch;

an integrated circuit connected to the switch;

a plurality of lamps operably connected to the integrated circuit, the plurality of lamps selected from the group consisting of incandescent lamps, LEDs, bi-color LEDs, and tri-color LEDs; and a housing mounted to the skate with an adjusting screw, the housing containing the plurality of lamps, wherein the adjusting screw allows the housing to be mounted to skates of vroius sizes.

12. The system of claim 11, wherein the housing comprises two portions.

13. The system of claim 11, further comprising at least one pattern of signals stored in the integrated circuit, the at least one pattern selected from the group consisting of a random pattern, a sequence, a reverse sequence, an in-phase pattern, and an out-of-phase pattern.

14. The system of claim 13, wherein a user selects the pattern with the at least one switch.

15. The system of claim 11, wherein the at least one switch is selected from the group consisting of an inertia switch, a touch switch and an on/off switch.

16. The system of claim 11, wherein the housing is within a space defined by the skate and a plane intersecting the skate.

17. A method for attaching an illuminating system to an ice skate or an in-line skate, the method comprising:

placing an illuminating system with a housing onto the ice skate or in-line skate; and adjusting a fit of the housing on the skate with an adjusting screw.

18. The method of claim 17, wherein placing the housing on the skate comprises placing a first portion of the housing on a first side of the skate and placing a second portion of the housing on a second side of the skate.

19. The system of claim 1, further comprising the skate, wherein the skate is an ice skate or an in-line skate.

20. The system of claim 11, further comprising an ice-skate or an in-line skate.

* * * * *